US005118304A

United States Patent [19]

Fujitani et al.

[11] Patent Number: 5,118,304

[45] Date of Patent: Jun. 2, 1992

[54] ELECTRICAL CONNECTOR ASSEMBLY

[75] Inventors: Mitsuhiro Fujitani; Hiroyuki Oka; Nori Inoue; Hisashi Konoya, all of Mie, Japan

[73] Assignee: Sumitomo Wiring System, Ltd., Mie, Japan

[21] Appl. No.: 670,441

[22] Filed: Mar. 11, 1990

[30] Foreign Application Priority Data

Mar. 13, 1990 [JP] Japan ..... 2-25494

[51] Int. Cl.[5] ..... H01R 13/28; H01R 25/00; H01R 13/42

[52] U.S. Cl. ..... 439/290; 439/595; 439/594

[58] Field of Search ..... 439/290, 291, 594, 595, 439/603

[56] References Cited

U.S. PATENT DOCUMENTS 3,623,152 11/1971 Gutshall ..... 339/47 R
4,061,406 12/1977 Kunkle ..... 339/47 C
4,162,815 7/1979 Fleischhakes ..... 439/290
4,565,416 1/1986 Rudy et al. ..... 439/595

FOREIGN PATENT DOCUMENTS 0123383 10/1984 European Pat. Off. .
63-24622 7/1988 Japan .
968814 9/1964 United Kingdom .
1012876 12/1965 United Kingdom .
2044557 10/1980 United Kingdom .
1602827 11/1981 United Kingdom .

*Primary Examiner*—Paula A. Bradley
*Attorney, Agent, or Firm*—Wenderoth, Lind & Ponack

[57] ABSTRACT

An electrical terminal for forming an electrical connector assembly has an electrical wire connecting portion and a tubular terminal connecting portion extending forward from the electrical connecting portion. First and second axes are defined in the cross-sectional plane of the terminal connecting portion. A plurality of slots are formed in the terminal connecting portion with at least one of the slots extending from the free end of the terminal connecting portion toward the electrical wire connecting portion. when the connecting portion of one electrical terminal is fitted in the slot formed in the connecting portion of another electrical terminal, the respective electrical terminals are sequentially connected in a chained fashion in the direction of the first axes, the second axes of the respective connecting portions are parallel to each other, and the first axes of the respective connecting portions are in alignment with each other.

7 Claims, 5 Drawing Sheets

ELECTRICAL CONNECTOR ASSEMBLY

BACKGROUND OF THE INVENTION

1. Field of the Invention

The present invention relates to an electrical connector assembly for use in forming a branch circuit for a wiring harness, and more particularly to an electrical terminal adapted to be connected in a row in a chained fashion, a connector housing for accommodating electrical terminals connected to each other in a row in a chained fashion, and an electrical connector assembly for use in forming a branch circuit which comprises the electrical terminals and the connector housing that are combined together.

2. Statement of the Prior Art

A prior art electrical terminal is disclosed in Japanese Utility Model Publication No. 24622/1988. This known electrical terminal has a two-stage box-shaped contact portion constituted by lower narrow and upper wide portions. The rear end of a top wall of the upper wide portion forms a tab-like connecting piece, while a slot for receiving the top wall of a wide portion is formed in the lower narrow portion in such a manner as to extend from the front to the rear thereof. A tongue piece extends from a bottom plate of the narrow portion rearwardly in a curved fashion. When the top wall of the wide portion of one electrical terminals is fitted into the slot in the narrow portion of another electrical terminal so that the tab-like connecting piece of the former is brought into contact with the tongue piece of the latter, the upper and lower portions are connected to each other in a row in a chained fashion for accommodation in a connector housing.

Since the above prior art electrical terminal is constructed such that the upper and lower portions of the two-stage box-shaped contact portion are to be connected to each other in a row in a chained fashion, the contact portion of the electrical terminal itself is inevitably large, and a pitch between electrical terminals connected to each other in a row in a chained fashion is also large. Thus, the prior art electrical terminal has drawbacks in that it does not meet current technical requirements of compactness and miniaturization for a wiring harness and in that the electrical terminal cannot be fabricated efficiently due to its complicate configuration.

SUMMARY OF THE INVENTION

An object of the present invention is to realize a miniaturized compact wiring harness by providing electrical terminals which can be connected to each other in a row in a chained fashion at a minimal pitch.

Another object of the present invention is to provide a connector housing for accommodating the chained assembly of electrical terminals.

A further object of the present invention is to provide an electrical connector assembly for use in forming a branch circuit for a wiring harness in which an arbitrary number of electrical terminals can be chained.

An electrical terminal for use in forming an electrical connector assembly according to the present invention has an electrical wire connecting portion and a tubular terminal connecting portion extending forward from the electrical wire connecting portion. First and second axes are defined in the cross-sectional plane of the terminal connecting portion. A plurality of slots are formed in the terminal connecting portion with at least one slot extending from the free end thereof toward the electrical wire connecting portion. This slot is formed such that when the connecting portion of one electrical terminal is fitted in the slot formed in the connection portion of another electrical terminal, the respective electrical terminals are connected in a sequential chained fashion, the second axes of the respective connecting portions are parallel to each other, and the first axes of the respective connecting portions are aligned with each other.

More specifically, a first slot is formed in the connecting portion of the electrical terminal in such a manner as to extend from the free end of the connecting portion toward the electrical wire connecting portion, and a second slot is formed in the connecting portion in such a manner as to extend from an end of the connecting portion, from which the electrical wire connecting portion extends, toward the free end. The final ends of these first and second slots lie substantially in the same cross-sectional plane of the connecting portion. The first and second slots are formed such that when the connecting portion of one electrical terminal is fitted in the slot formed in the connecting portion of the other electrical terminal, the respective electrical terminals are connected in sequence in a chained fashion with the second axes of the respective connecting portions being parallel to each other, while the first axes of the respective connecting portions are aligned with each other.

At least one locking window may be provided in the tubular connecting portion at locations through which the second axis passes.

A connector housing of an electrical connector assembly has a plurality of accommodating chambers for accommodating respective ones of the electrical terminals. A cantilever has a locking projection provided at the deepest position of the respective accommodating chamber.

A retainer may be inserted into at least one of the accommodating chambers, and this retainer has a locking recessed portion at one end thereof, and an angular elongate projection extending on one side longitudinally thereof.

In an electrical connector assembly for use in forming a branch circuit, electrical terminals are first connected to each other in a chained fashion, and are then accommodated in the connector housing. In the electrical connector assembly, the respective electrical terminals are accommodated in the respective accommodating chambers of the connector housing. The first axes of the respective electrical terminals are in alignment with each other and parallel to the first axis of the connector housing when the respective electrical terminals are connected to each other. The second axes of the respective electrical terminals that normally intersect the first axes thereof are juxtaposed and parallel to the second axis of the connector housing that intersects the first axis thereof. And the retainer is inserted into an accommodating chamber corresponding to a space between groups of electrical terminals that are connected to each other as desired.

Since the electrical terminals according to the present invention can be directly connected to each other in a row in a chained fashion via the tubular connecting portions having the slots therein, an electrical wire pitch of the group of electrical terminals that are connected in a row in a chained fashion can be made extremely small.

Moreover, not only is the tubular connecting portion smaller but also the configuration thereof is more simple compared with that of the aforementioned prior art.

DETAILED DESCRIPTION OF THE PREFERRED EMBODIMENTS

Referring to embodiments thereof, the present invention will now be described in detail. First, referring to FIGS. 1 to 4 showing a first embodiment of the present invention, an electrical terminal 1 of an electrical connector assembly of the present invention is constituted by an electrical wire connecting portion 3 provided at the rear-half of the electrical terminal 1 and a connecting portion 2 provided at the front-half of the same electric terminal in such a manner as to continuously extend from the former. This connecting portion 2 comprises a tubular body formed from a single sheet of material and having a square cross section.

A vertical diagonal line (first axis) 5 passing through two corners at the front end of the square tubular body and a vertical center line 4 of the connecting portion 2, are vertical and parallel when one of the corners of the square tubular body is situated at the bottom of the electrical terminal 1.

Slots 9A are formed in two sides 7A, 7B of the connecting portion 2 of the square tubular body that form therebetween an upper corner of the connecting portion 2 at a position slightly above the transversely intermediate portion of the terminal. Slots 9A extend longitudinally forward from the rear end of the connecting portion 2 to substantially a longitudinal intermediate position of the connecting portion 2. Similarly, slots 9B are formed in two sides 8A, 8B of the connecting portion 2 of the square tubular body that form therebetween a lower corner of the connecting portion 2 at a position slightly below the transversely intermediate portion of the terminal. Slots 9B extend longitudinally forward from the front free end of the connecting portion 2 to substantially a longitudinal intermediate position of the connecting portion 2. These slots 9A, 9B constitutes press contact fitting slots adapted to receive the adjacent two sides 7A, 7B and 8A, 8B of the connecting portion 2 of another electrical terminal 1, respectively.

Figure 1:
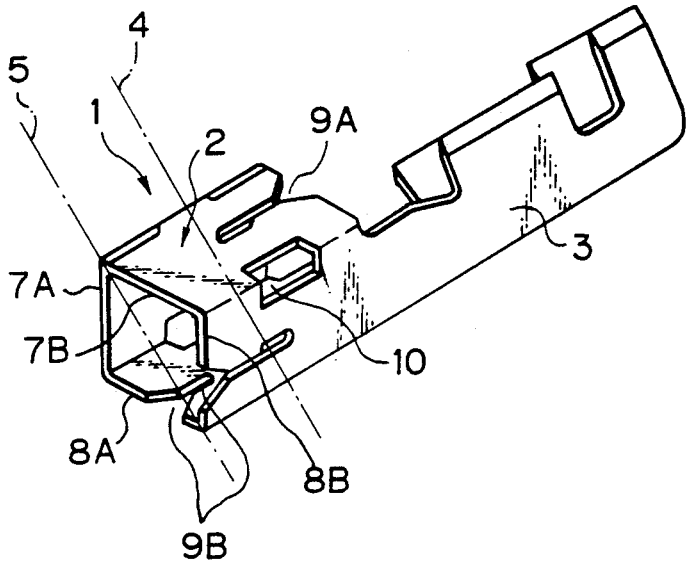
FIG. 1 is a perspective view of an electrical terminal used in an electrical connector assembly according to the present invention.
Figure 2:
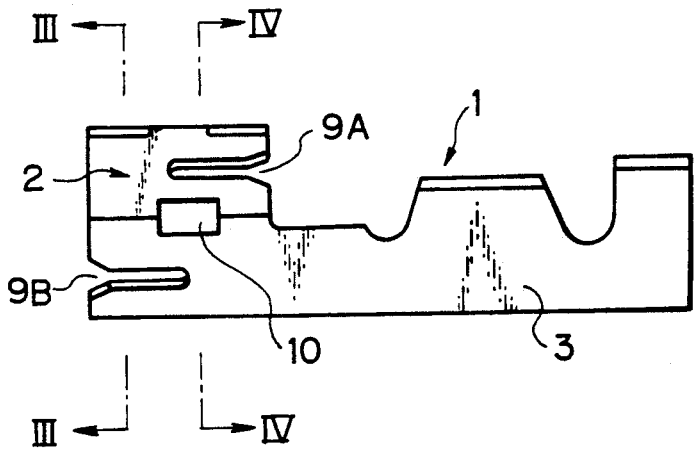
FIG. 2 is a side view of the terminal shown in FIG. 1.
Figure 3:
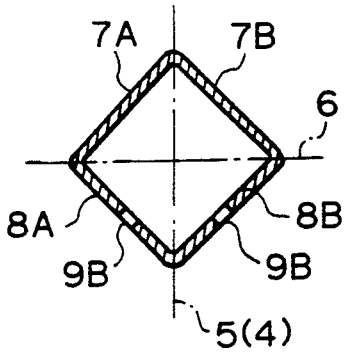
FIG. 3 is a cross-sectional view taken along line III—III of FIG. 2.
Figure 4:
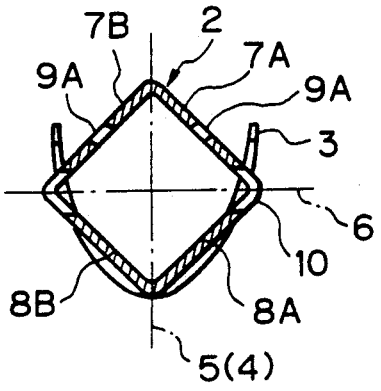
FIG. 4 is a cross-sectional view taken along line IV—IV of FIG. 2.
Figure 5:
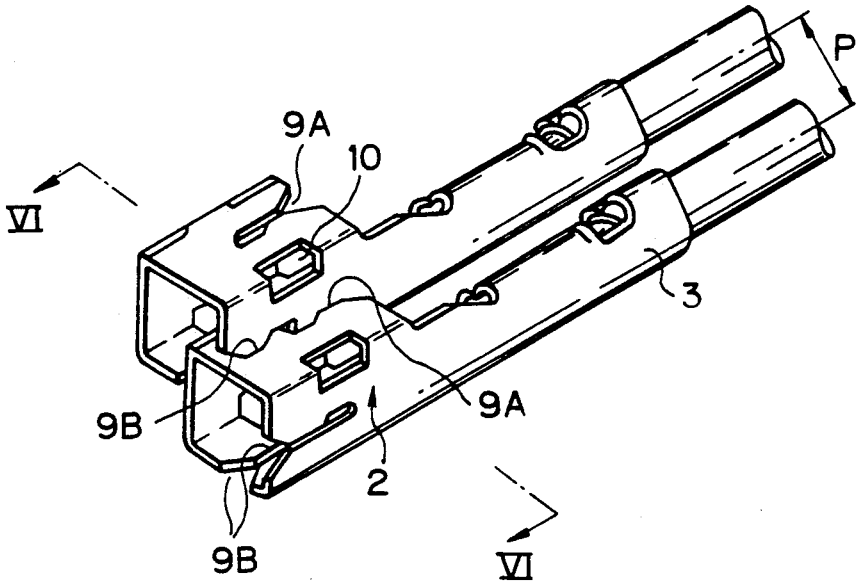
FIG. 5 is a perspective view of electrical terminals of the present invention connected to each other in a chained fashion.
Figure 6:
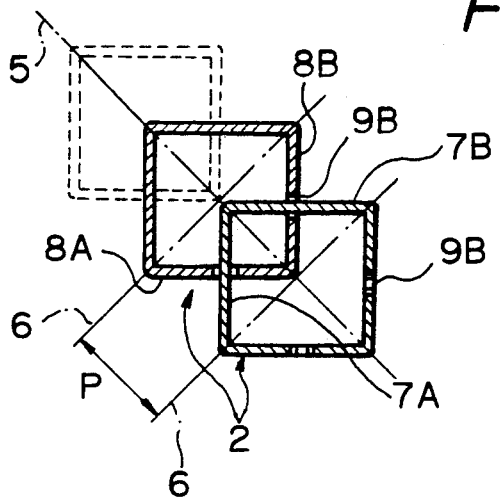
FIG. 6 is a cross-sectional view taken along line VI—VI of FIG. 5.

As shown in FIGS. 5 and 6, when two electrical terminals 1 are connected to each other in a chained fashion by meshingly fitting the surface 8B, in which the slot 9B of the connecting portion 2 of one electrical terminal is defined, over the surface 7B, in which the slot 9A of the connecting portion 2 of another electrical terminal is defined, the front ends of the connecting portions 2 of the two electrical terminals coincide with each other, while the two electrical terminals are directly connected to each other in parallel with a small pitch. Thus, any number of electrical terminals 1 may be sequentially connected to one another in a row in a chained fashion.

A locking window 10 is formed in the respective corners through which the horizontal diagonal line (second axis) 6 of the connecting portion 2 extends. And as will be described later, a group of electrical terminals connected to each other in a row in a chained fashion as described above are accommodated in a connector housing 11 as locked therein.

Figure 7:
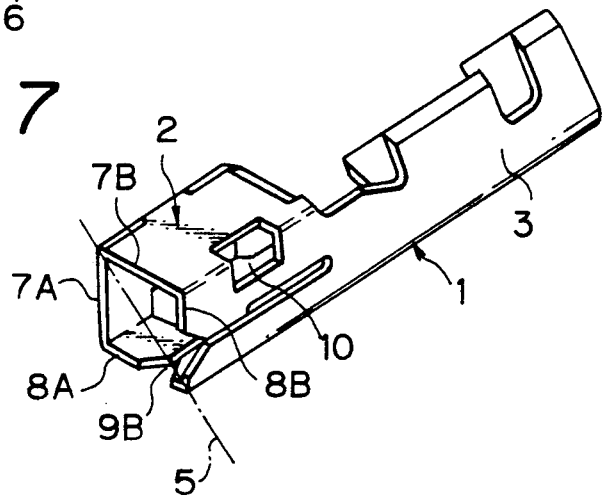
FIG. 7 is a perspective view of another embodiment of the electrical terminal of the present invention.

Next, referring to FIGS. 7 and 8, another embodiment of the electrical terminal according to the present invention will be described. In this embodiment, although a similar square tubular body having a similar connecting portion is used, slots similar to those formed in the two sides 7A, 7B of the connecting portion 2 of the square tubular body that form therebetween the upper corner thereof in the former embodiment are omitted. While on the other hand, slots 9B extend deep into sides 8A, 8B of the connecting portion that form therebetween a lower corner thereof.

This embodiment is also constructed such that two electrical terminals 1 can be connected to each other in a row in a chained fashion by fitting the slots 9B of one electrical terminal 1 over the two sides 7A, 7B of the other electrical terminal 1 that form an upper corner of the connecting portion therebetween from the rear end of the latter.

In the above two embodiments, since the electrical terminals are to be connected to each other by means of the slots 9A, 9B, or 9B, 9B both formed in the two sides of the connecting portion 2 of the square tubular body, the pitch of chained electrical terminals is small, whereby the configuration of the connecting portion 2 is simplified when compared with the aforementioned prior art, thereby making it possible to improve the efficiency of fabricating the electrical terminals 1.

Next, referring to FIGS. 9 to 12, one embodiment of the connector housing 11 for forming the electrical connector assembly according to the present invention will be described.

In the connector housing 11 for accommodating the electrical terminals 1, a plurality of accommodating chambers 15 are defined by vertically confronting upper and lower wall portions 13, 14 each defining angled receiving grooves 12 and continuously extending in a serrated fashion. A pair of opposite corners of the connecting portion 2 of the electrical terminal, through which the second axis 6 extends, are held in a vertically spaced relation in an opposing pair of grooves 12.

Figure 8:
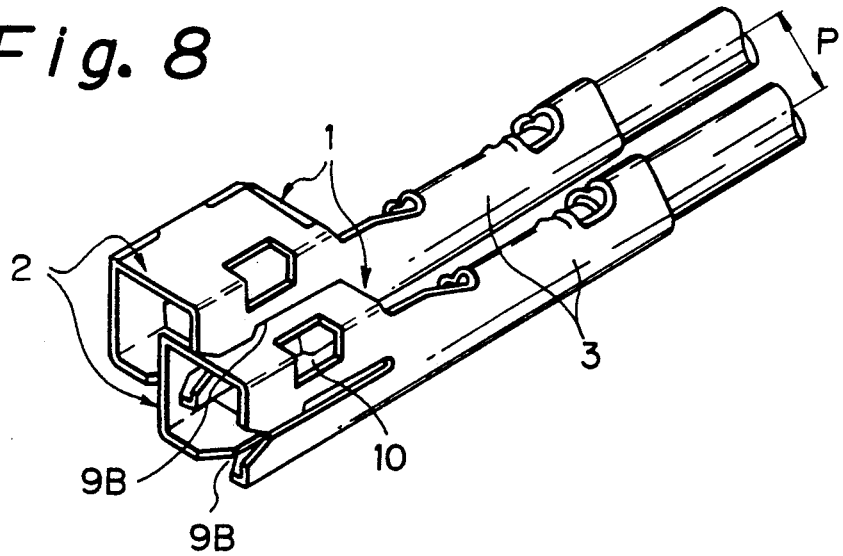
FIG. 8 is a perspective view of the electrical terminals shown in FIG. 7 connected to each other in a chained fashion.

The pitch of the angled receiving grooves 12 coincide with the pitch P with which the electrical terminals 1 are connected to each other as shown in FIGS. 5 and 8.

Figure 9:
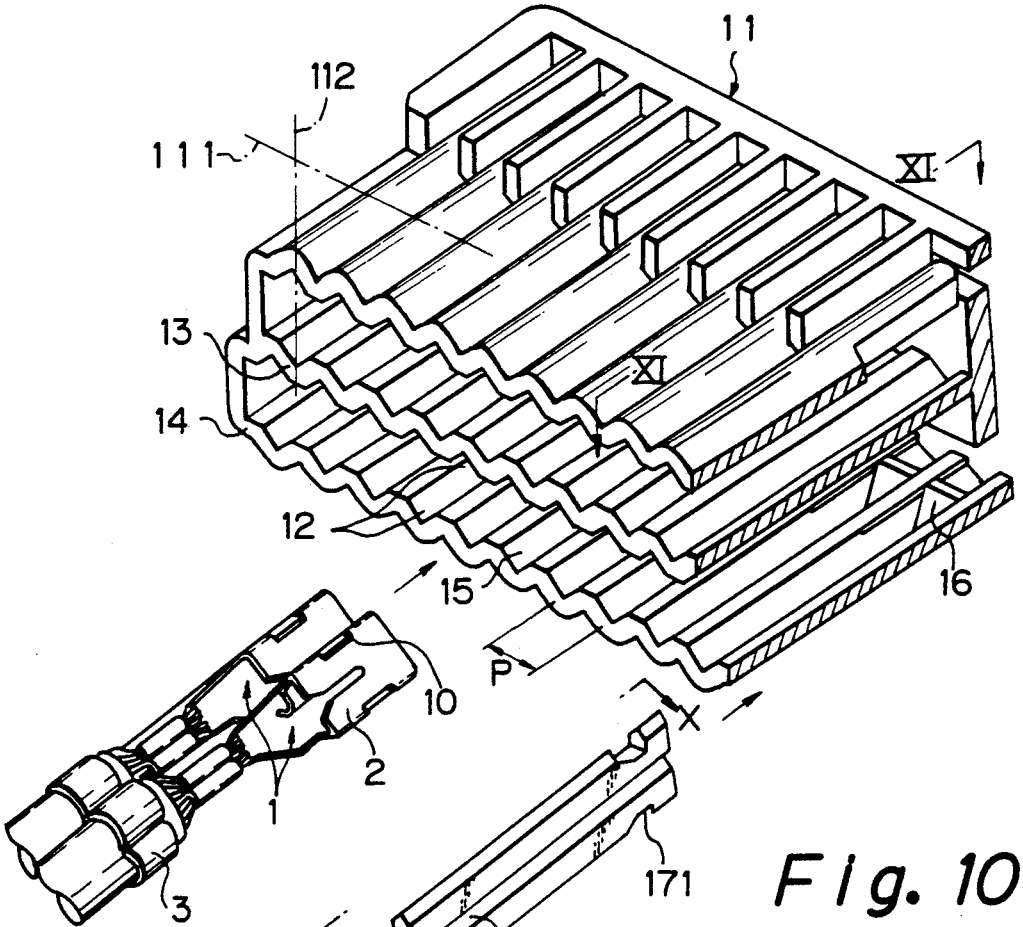
FIG. 9 is a perspective view of a connector housing used in the electrical connector assembly according to the present invention.

As shown in FIG. 9, the connector housing 11 defines first and second axes 111, 112, and these first and second axes normally intersect each other. The first axis coincides with the direction in which the electrical terminals 1 are connected to each other when they are received in the accommodating chambers 15.

Figure 11:
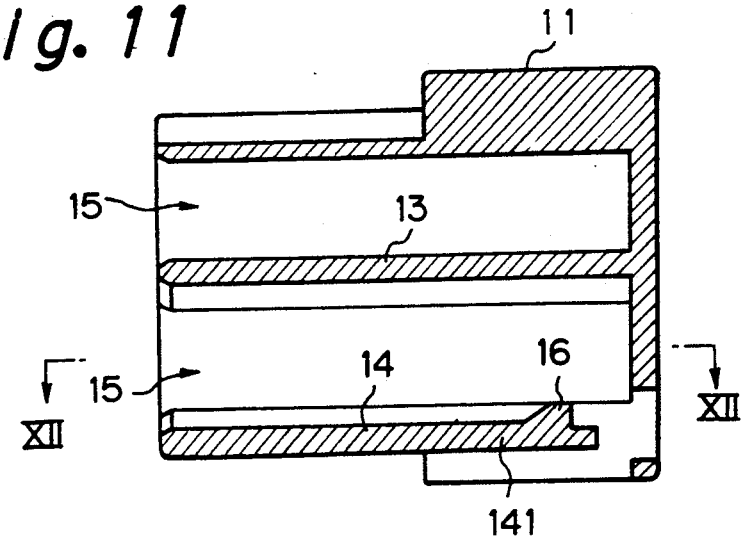
FIG. 11 is a vertical sectional view of the connector housing taken along line XI—XI of FIG. 9.
Figure 12:
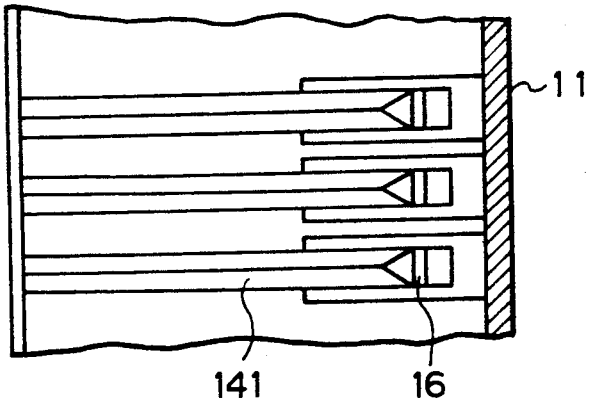
FIG. 12 is a partial plan view as viewed in the direction XII—XII of FIG. 11.

As best seen in FIGS. 11 and 12, a locking projection 16 projects from a cantilever arm 141 within either of a pair of vertically confronting angled receiving grooves 12.

With the locking windows 10 formed in the connecting portion 2 being oriented vertically, an individual electrical terminal 1 is inserted into a pair of vertically confronting angled receiving grooves 12 so that the locking window 10 is brought into engagement with the locking projection 16, whereby the individual electrical terminal 1 is thus locked in place. The electrical terminals 1 are then inserted sequentially so as to be locked to the individual terminal, whereby any number of electrical terminals 1 can be accommodated in the connector housing 11 while being horizontally connected to each other in a row in a chained fashion.

In assembling the electrical terminals 1, several electrical terminals 1 may be brought into engagement with each other in advance outside the connector housing 11 before they are integrally inserted into the connector housing 11, or the electrical terminals 1 may be inserted into the connector housing 11 one by one such the adjacent electrical terminals 1 so inserted are brought into engagement with each other.

Figure 10:
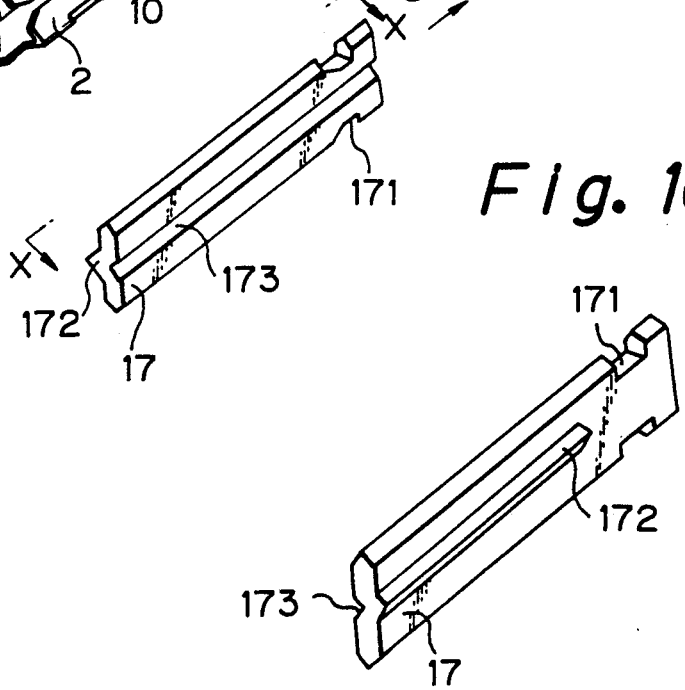
FIG. 10 is a perspective view of a retainer as viewed from the back thereof in the direction shown by line X—X of FIG. 9.

As shown in FIGS. 9 and 10, a retainer 17 has a locking recessed portion 171 at one end thereof, an angled elongate projection 172 extending longitudinally along one side thereof, and a V-shaped groove 173 extending longitudinally in the other side thereof.

Figure 13:
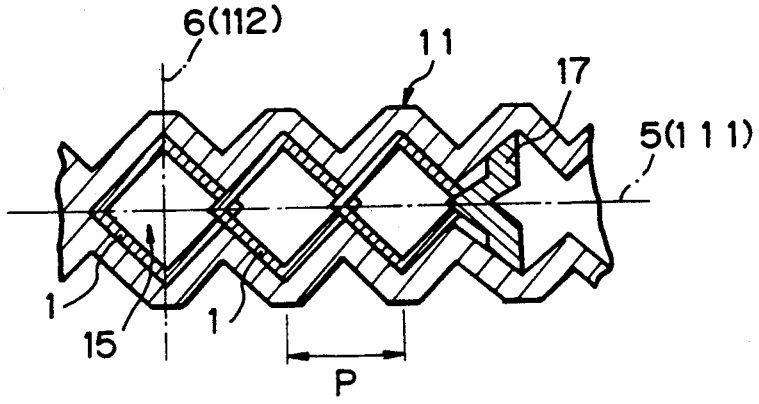
FIG. 13 is a partial cross-sectional view of the electrical connector assembly for use in forming a branch circuit.

This retainer 17 is designed to be inserted into the connector housing 11 as a partition. For instance, the retainer 17 may be used as a partition when inserting separate groups of a plurality of electrical terminals into the housing. In this case, the recessed portion 171 at the leading end of the retainer 17 is brought into engagement with the locking piece 16 of the connector housing 11 as in the case of the electrical terminals 1, while the corner portions of one group of the electrical terminals 1 are pressed by the leading end of the angled elongate projection 172 formed on one side of the retainer 17 (FIG. 13). The lastly inserted one of another group of the electrical terminals connected to each other in a row in a chained fashion is pressed by another retainer 17, whereby a series of electrical terminals 1 is accommodated and secondarily locked in the horizontally elongate accommodating chambers 15.

Lastly, as partly shown in FIG. 13, in an electrical connector assembly for use in forming a branch circuit, the respective electrical terminals 1 are accommodated in the respective accommodating chambers 15 of the connector housing 11. The first axes 5 of the respective electrical terminals 1 are disposed in parallel to the first axis 111 of the connector housing 11 while being aligned with each other, when the respective electrical terminals 1 are connected to each other. The second axes 6 of the respective electrical terminals 1 that normally intersect the first axes 5 thereof are disposed in parallel to the second axis 112 of the connector housing 11 that normally intersects the first axis 111 thereof. And the retainer 17 is inserted into an accommodating chamber 15 corresponding to a space between groups of desired numbers of connected electrical terminals.

We claim:

1. An electrical terminal for forming an electrical connector assembly, said electrical terminal comprising an electrical wire connecting portion adapted to secure a wire in an electrically conductive relation to the terminal, and a tubular terminal portion having one end from which said electrical wire connecting portion extends, a free end opposite said one end, and a first slot open at said free end of the terminal portion and extending from said free end toward said one end, and a second slot open at said one end of the terminal portion and extending from said one end toward said free end, said first and said second slots terminating at respective ends thereof in said terminal portion, the ends of said slots being located substantially in a common plane extending perpendicular to the longitudinal axis of said tubular terminal portion.

2. An electrical terminal as claimed in claim 1, wherein said tubular connecting portion has an aperture extending radially therethrough.

3. A connector housing of an electrical connector assembly, said connector housing comprising walls defining a plurality of accommodating chambers open at a front end of the housing and adapted to respectively accommodate electrical terminals inserted therein through the front end of the housing, one of said walls supported as a cantilever in the connector housing and having a locking projection extending into a respective one of said chambers at an end thereof remote from the front end of the housing to which said chambers are open, and a retainer extending in said one of said chambers, said retrainer having a recessed portion at one end thereof engaged with said locking projection such that said retainer is locked in place by said one of said walls, an angular elongate projection extending longitudinally along one side thereof, and a groove having a V-shaped cross section extending longitudinally in the other side thereof.

4. An electrical connector assembly for use in forming a branch circuit, said electrical assembly comprising a connector housing having walls defining a plurality of accommodating chambers at least some of which are aligned with one another, and said connector housing defining a first axis parallel to the direction in which said at least some of the accommodating chambers are aligned with each other and a second axis normal to said first axis; a plurality of similar electrical terminals connected directly to each other in a chained fashion and disposed in such a connected state within said at least some of said accommodating chambers, respectively, each of said terminals defining first and second axes normal to each, the first and second axes defined by said terminals passing through corresponding portions of each of said similar terminals, respectively, said first axes defined by said electrical terminals being coincident and parallel to the first axis defined by said connector housing, and the second axes defined by said electrical terminals being juxtaposed and parallel to the second axis defined by said connector housing; and a retainer extending into a respective one of said accommodating chambers and retaining said electrical terminals within said at least some of said accommodating chambers.

5. An electrical connector assembly as claimed in claim 4, wherein said retainer has a recessed portion at an end thereof engaged with said connector housing such that said retainer is locked in place, an angular projection extending longitudinally along one side thereof and engaged with one of said electrical terminals, and a groove having a V-shaped cross section extending longitudinally in the other side thereof.

6. An electrical connector assembly as claimed in claim 4, wherein each of said electrical terminals includes an electrical wire connecting portion securing a wire in an electrically conductive relation with the terminal, and a tubular terminal portion integral with said electrical wire connecting portion, wherein said first and said second axes defined by each of said terminals lies in a cross-sectional plane of the tubular terminal portion thereof, and wherein said tubular terminal portion has slots defined therein, said slots of each of said terminals receiving respective portions of a said terminal connected directly thereto.

7. An electrical connector assembly as claimed in claim 7, wherein each of said electrical terminals includes an electrical wire connecting portion securing a wire in an electrically conductive relation with the terminal. and a tubular terminal portion having one end from which said electrical wire connecting portion extends, a free end opposite said one end, and a first slot open at said free end of the terminal portion and extending from said free end toward said one end, and a second slot open at said one end of the terminal portion and extending from said one end toward said free end, said first and said second slots terminating at respective ends thereof in said terminal portion, and the ends of said slots being located substantially in a common plane extending perpendicular to the longitudinal axis of said tubular terminal portion.

* * * * *

UNITED STATES PATENT AND TRADEMARK OFFICE

CERTIFICATE OF CORRECTION

PATENT NO. : 5,118,304

DATED : June 2, 1992

INVENTOR(S) : Mitsuhiro FUJITANI ET AL.

It is certified that error appears in the above-identified patent and that said Letters Patent is hereby corrected as shown below:

On the Abstract page, the filing date of the application under item [22] has been changed to --March 11, 1991--.

Signed and Sealed this

Second Day of November, 1993

Bruce Lehman

*Attest:*

BRUCE LEHMAN

*Attesting Officer*

*Commissioner of Patents and Trademarks*